US005324126A

United States Patent [19]

Holloway et al.

[11] Patent Number: 5,324,126

[45] Date of Patent: Jun. 28, 1994

[54] COSMETIC DISPENSER WITH LONG LASTING SWIVEL DRAG EFFECT

[75] Inventors: Thomas F. Holloway, Southbury; Walter Ackermann, Watertown, both of Conn.

[73] Assignee: Risdon Corporation, Naugatuck, Conn.

[21] Appl. No.: 49,952

[22] Filed: Apr. 20, 1993

[51] Int. Cl.[5] ..... A45D 40/00; A45D 40/06

[52] U.S. Cl. ..... 401/78; 401/80

[58] Field of Search ..... 401/78, 80

[56] References Cited

U.S. PATENT DOCUMENTS

| | | | |
|---|---|---|---|
| 2,840,229 | 6/1958 | Hopgood | 206/56 |
| 2,840,231 | 6/1958 | Reichenbach | 206/56 |
| 2,913,103 | 11/1959 | Isele | 206/56 |
| 3,335,853 | 8/1967 | Geisel | 206/56 |
| 3,515,493 | 6/1970 | Gruska | 401/74 |
| 3,620,632 | 11/1971 | Gruska | 401/78 |
| 3,850,183 | 11/1974 | Gruska | 132/88.7 |
| 4,750,501 | 6/1988 | Ackermann et al. | 132/79 |
| 4,812,066 | 3/1989 | Gueret | 401/78 |
| 5,096,318 | 3/1992 | Susini et al. | 401/80 |
| 5,186,560 | 2/1993 | Holloway | 401/78 |
| 5,186,561 | 2/1993 | Ackerman et al. | 401/80 X |

FOREIGN PATENT DOCUMENTS

| | | | |
|---|---|---|---|
| 2053268 | 5/1972 | Fed. Rep. of Germany | 401/78 |
| 3812777 | 10/1989 | Fed. Rep. of Germany . | |
| 1118889 | 7/1968 | United Kingdom | 401/80 |
| 2213467 | 8/1989 | United Kingdom | 401/78 |

*Primary Examiner*—Steven A. Bratlie

*Attorney, Agent, or Firm*—St. Onge Steward Johnston & Reens

[57] ABSTRACT

A cosmetic preparation dispenser is provided that has a resilient tab formed on the lower end of the innerbody that presses against the cam sleeve to provide a desirable swivel drag, and which tab is prevented from undesirable deformation that reduces the swivel torque by providing a relaxation zone in the cam sleeve where the tab can recall its original shape. The relaxation zone is preferably a thin walled section of the cam sleeve that is formed by the combination of a flat outer wall and a circular inner wall, which thin walled section is deformable by pressure from the tab when the tab is seated against the thin walled section. The tab presses against the cam sleeve which causes the cam sleeve to move up a bevelled shoulder to enhance swivel drag between the cam sleeve and a retaining lip on the innerbody. The bevelled shoulder also engages the cam sleeve when force is applied to the elevator.

30 Claims, 4 Drawing Sheets

COSMETIC DISPENSER WITH LONG LASTING SWIVEL DRAG EFFECT

FIELD OF THE INVENTION

The present invention relates to the field of cosmetic and lipstick dispensers, and particularly to a dispenser suited to provide a consistent and long lasting frictional swivel drag effect during operation of the dispenser.

BACKGROUND OF THE INVENTION

Conventional propel/repel lipstick dispensers typically have an outer helical cam track sleeve and a longitudinal track innerbody rotatable inside the cam sleeve to axially propel and retract an elevator cup with a lug or lugs that track in the cam track and in the longitudinal track.

It is known in the art to provide cosmetic dispensers such as lipstick cases with a desirable frictional drag "feel" to the consumer operator when the dispenser is operated to extend or retract the cosmetic stick. It is desirable in providing such a feel that the swivel torque needed to rotate the components to dispense the lipstick remain nearly constant, regardless of whether the dispenser is nearly full or exhausted of the cosmetic. The swivel torque should be significant enough to impart a firm feel to the dispenser. Looseness, uneven drag, or inconsistency of torque can be interpreted by the consumer as indicating an inferior quality product.

The prior art has attempted to provide the desired firmness and consistency of swivel torque by a number of devices. U.S. Pat. No. 4,750,501 to Ackermann et al. is an example of one type of cosmetic applicator wherein an objective is to impart an even drag and swivel torque during operation. In other prior art devices, two lugs or tabs are provided on the elevator cup to press against the innerbody or the cam sleeve to provide frictional interference therebetween; in other devices ribs have been provided on the innerbody that frictionally fit against the elevator cup. However, these prior art devices have generally suffered from inconsistent swivel torque along the travel of the elevator cup as it moves from the extended to the retracted position. This problem arises because the effective inner diameter of the innerbody can vary along its length and thereby vary the swivel torque in an undesirable manner. The dispenser can therefore tend to feel looser when the cup is at one end and tighter when the cup is at the other end.

In yet other prior art devices, two lugs or tabs are provided on the innerbody to press against the cam sleeve to provide frictional interference between the two rotating elements of the dispenser. Such a device is shown for example in U.S. Pat. No. 5,186,560, issued Feb. 16, 1993 to Holloway, the disclosure of which is hereby incorporated by reference, as well as in U.S. Pat. No. 5,186,561 issued Feb. 16, 1993 to Ackermann and Holloway, the disclosure of which is hereby incorporated by reference. It has been found that over long periods of time the resilient flex tabs can sometimes lose their frictional engagement with the cam sleeve. This is believed to be due to the use of a plastic material to form the innerbody. The plastic experiences "cold flow" from the force of the flex tab against the cam sleeve, so that the flex tab is eventually bent out of position. The bent flex tab will have a substantially reduced frictional engagement with the cam sleeve.

Another problem found in certain prior art dispensers is the problem of pomade back-off. Pomade back-off occurs when a consumer is using a lipstick dispenser and the force of applying the lipstick to the consumer's lips pushes the pomade and elevator cup down the helical tracks of the dispenser. Pomade back-off is generally prevented when the pomade is fully extended by providing horizontal locking tracks at the upper end of the inner body longitudinal tracks. However, if the consumer does not fully extend the pomade (as can often occur when a new lipstick is being used), the locking tracks are unavailing since the elevator cup is not extended sufficiently to engage in the locking tracks. Pomade back-off is most noticeable in single turn dispensers (in which the cam tracks extend around 360 degrees of the dispenser) which have relatively higher cam angles, so that pressure on the elevator cup tends to move the cup and pomade back down the cam and innerbody tracks. This problem is less acute in higher turn dispensers such as double or triple turn dispensers. However, for the convenience of a consumer, a single turn dispenser is preferable as it is easier and more elegant to use.

SUMMARY OF THE INVENTION

It is an object of the invention to provide an improved cosmetic preparation dispenser having a mechanism to provide a consistent swivel torque which minimizes loss over time of the frictional drag that provides the desirable swivel torque. The desirable swivel torque imparts a luxurious feel associated in the perception of the consumer with a higher quality product.

It is a further object of the invention to provide an improved cosmetic preparation dispenser that reduces pomade back-off that can occur when a consumer applies pressure to a cosmetic pomade. It is an object of the present invention that the reduced pomade back-off feature be effective across the entire travel of the elevator cup.

In accordance with the present invention, a cosmetic dispenser includes a cam sleeve, innerbody and elevator cup, with a molded resilient tab on the innerbody that presses against the cam sleeve for creating a swivel drag between the dispenser's cam sleeve and innerbody. The cam sleeve is provided with a relaxation zone where the tab can be seated to provide an opportunity for the tab to recall its original molded shape, so that the tab will maintain a consistent frictional braking effect over time. In the absence of the relaxation zone, the tab can become ineffective over time as cold flow of the tab material causes the tab to deform and lose its ability to press against the cam sleeve. The relaxation zone is located so that the tab seats in the relaxation zone when the dispenser is retracted and when it is fully extended. Since the consumer will typically retract the pomade after using the dispenser, and since the dispenser is only in actual use a small percentage of the time, the relaxation zone operable upon retraction provides ample opportunity for the tab to recall its original molded shape.

The relaxation zone may take several embodiments. One preferred embodiment comprises a deformable section of the base wall which is made of a polymeric material. The deformable section deflects when a tab is pressed against the deformable section and gives the tab the opportunity to regain its original shape. Such a deformable section may be provided by manufacturing the lower base wall of the cam sleeve with a flat area on the outer wall of the base wall, so that the wall thickness of the base wall is reduced to weaken the wall only at the deformable section. This renders the wall deformable in accordance with the invention. Moreover, by placing the flat area on the outer wall, the inner wall is circular so that a consistent swivel drag torque is provided. In the preferred embodiment of the thin wall embodiment, there is one tab and two deformable relaxation zones. Another embodiment of the relaxation zone may comprise a notch in the inner wall of the cam sleeve.

Further to the invention, a bevelled shoulder section is provided around the outer walls of the base of the innerbody. The lower skirt of the cam sleeve rides on the bevelled base. The flex tab operating on one side of the cam sleeve causes the cam sleeve to tend to ride up the bevelled shoulder to increase frictional drag between the upper lip of the cam sleeve and a retaining lip of the innerbody to enhance the frictional effect. The increased friction thereby provided improves the feel of the dispenser and also reduces pomade back-off by making it more difficult for the dispenser components to rotate freely. This combination also reduces pomade back-off because force on the pomade is translated to the interface of the lower skirt of the cam sleeve and the bevelled shoulder, causing the cam sleeve to frictionally lock in place against the bevelled shoulder of the innerbody. This prevents the innerbody and cam sleeve from rotation relative to each other and substantially eliminates pomade back-off.

Other objects, aspects and features of the present invention in addition to those mentioned above will be pointed out in or will be understood from the following detailed description provided in conjunction with the accompanying drawings.

DETAILED DESCRIPTION OF THE PREFERRED EMBODIMENT

Figure 2:
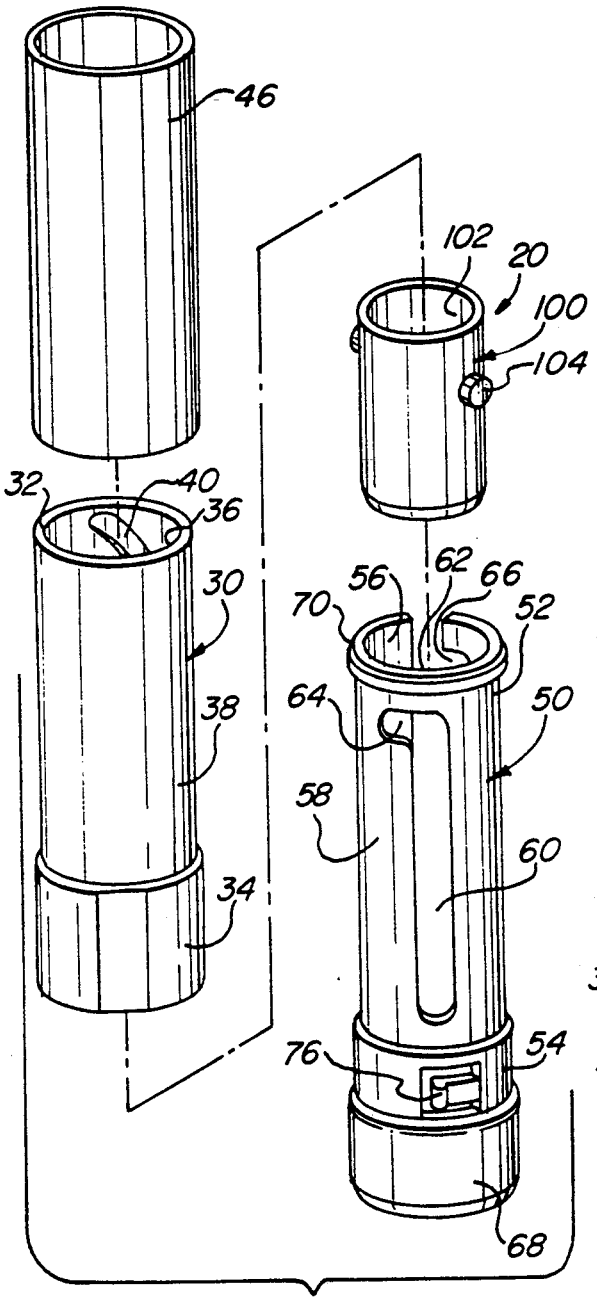
FIG. 2 is an exploded view of the dispenser of FIG. 1.
Figure 1:
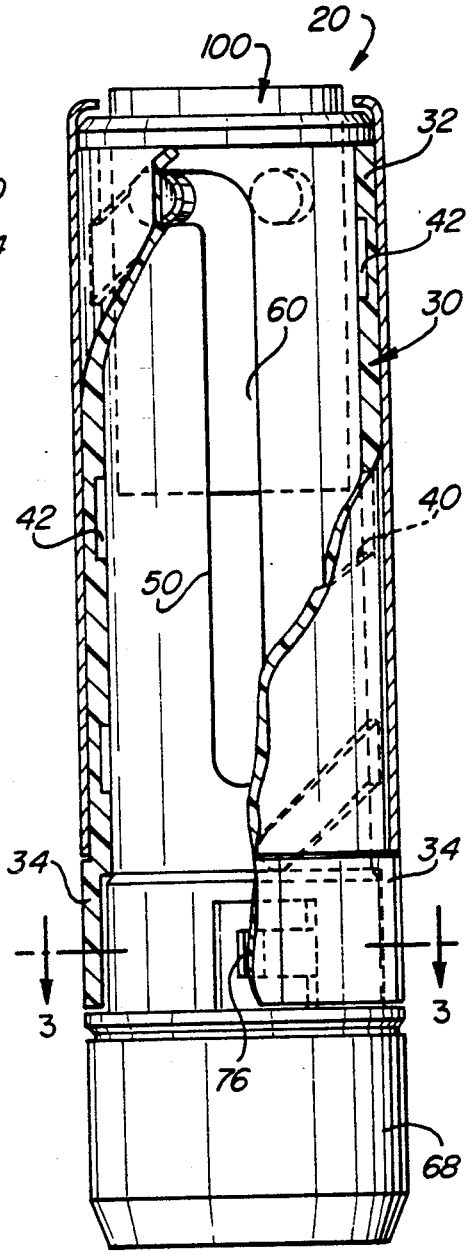
FIG. 1 is a perspective view with a partial cutaway of an embodiment of a cosmetic dispenser with long lasting friction tab effect in accordance with the invention.
Figure 3:
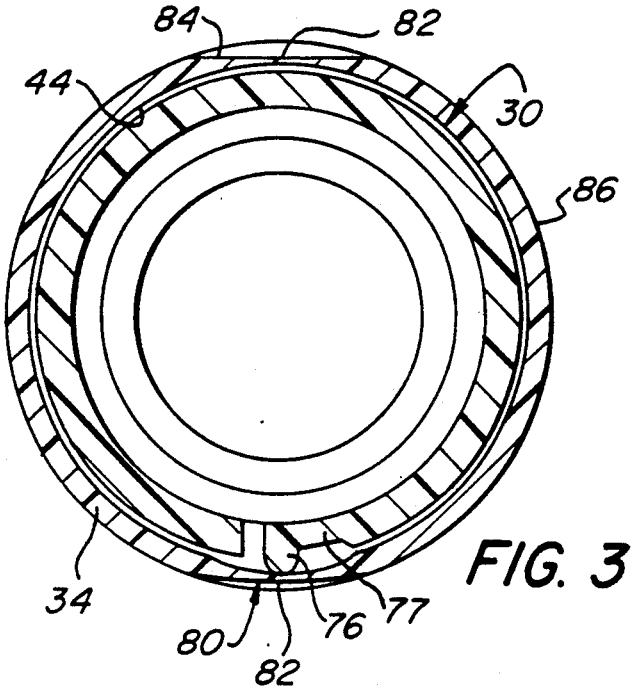
FIG. 3 is a cross-sectional view along the line 3—3 of FIG. 1.
Figure 6:
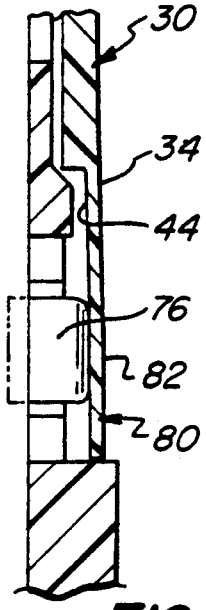
FIG. 6 is a detail cross-sectional side elevation view of the dispenser of FIG. 3 showing a tab frictionally bearing against a cam sleeve base wall.

Referring now to FIGS. 1–12, where like elements are identified by like numbers in the drawings, an improved cosmetic dispenser with long lasting swivel drag and anti-back-off features is shown generally at 20. Dispenser 20 comprises a cam sleeve 30, an innerbody 50, and an elevator cup 100.

Cam sleeve 30 is rigid and tubular and has an upper end 32 and a lower base 34. Cam sleeve 30 has an inner wall 36 and an outer wall 38. At least one and preferably two internal helical tracks 40 and 42 are formed on the inner wall 36. Helical tracks 40 and 42 are located 180 degrees apart and extend along a substantial length of the inner wall 36 of the cam sleeve 30. Preferably, each helical track 40 and 42 provides one 360 degree circle in the inner wall 36 of cam sleeve 30. Cam sleeve 30 has a smooth inner wall 44 at its base 34. An ornamental outer shell 46 such as a brass tube may be fitted over the outer wall 38 of the cam sleeve for decoration.

Innerbody 50 is also tubular and has an upper end 52 and a lower end 54. Innerbody 50 has an inner wall 56 and an outer wall 58. Innerbody 50 is fitted into the cam sleeve 30 and has at least one and preferably two longitudinal tracks 60 and 62 which extend along the axial length of the innerbody 50 and which extend through the walls 56 and 58 of the innerbody 50 along a substantial length of the innerbody 50. Preferably, one of the longitudinal tracks 60 extends to the upper end 52 of the innerbody 50 so that it is open at its upper end. The other longitudinal track 62 preferably does not so extend so that it is closed at its upper end. This permits easy assembly of the elevator cup 100 into innerbody 50.

The longitudinal tracks 60 and 62 preferably have at their upper ends upper lateral track segments 64 and 66 respectively which preferably extend perpendicularly from the longitudinal tracks 60 and 62. The upper lateral track segments 64 and 66 assist the elevator cup 100 to be locked in an extended position for application of a cosmetic.

The innerbody 50 is interlocked with the cam sleeve 30 so that rotation or application of a swivel torque to the cam sleeve 30 relative to innerbody 50 can be accomplished by gripping an extended cylindrical portion 68 on innerbody 50 with one hand and cam sleeve 30 with the other hand to raise or lower elevator cup 100. The cam sleeve 30 and innerbody 50 are preferably secured together by a retaining lip 70 on the upper end 52 of innerbody 50 that retains the upper end 32 of cam sleeve 30 in place on innerbody 50. The knob 68 of innerbody 50 has a larger diameter than the lower end 34 of cam sleeve 30 and thereby holds the cam sleeve lower end 34 in place.

The elevator cup 100 is generally cylindrical and has a chamber 102 for containing a cosmetic preparation such as lipstick pomade 108. The cup 100 is fitted into the innerbody 50. Cup 100 has at least one and preferably two cam follower lugs 104 for seating in and following in the longitudinal tracks 60 and 62 of the innerbody 50 and the helical tracks 40 and 42 of the cam sleeve 30. The lugs 104 are located 180 degrees apart and have a sufficient length to extend through the longitudinal tracks 60 and 62 to engage the helical tracks 40 and 42. Cup 100 is movable in an axial path in a conventional manner by relative rotation of the innerbody 50 and cam sleeve 30 by virtue of the lugs 104 seating in the helical tracks 40 and 42 of cam sleeve 30 and the longitudinal tracks 60 and 62 of innerbody 50. The relative rotation of the cam sleeve 30 and innerbody 50 causes the cup 100 to move axially to propel the elevator cup 100 to an extended position, and relative rotation in the opposite direction causes the elevator cup 100 to retract to a retracted position. In the preferred embodiment, the helical tracks 40 and 42 are right hand threads in the cam sleeve 30 and have a thread pitch of about 30 degrees so that each makes one complete revolution as the cup 100 traverses the length of the dispenser 20. This is desirable as only a single turn is needed to fully activate the dispenser 20 or to fully retract the dispenser.

A resilient flex tab 76 is formed with and attached by tab root 77 to the lower end 54 of the innerbody 50. Preferably there is a single flex tab 76. The tab 76 is at least partially cut away from the innerbody 50 to enhance resilience. The flex tab 76 may have various embodiments as described in the art, and has sufficient resilience to be flexed radially inwardly.

The flex tab 76 provides a frictional braking effect against the inner wall 44 of the base 34 of cam sleeve 30, to give the desired drag and constant swivel torque. Because the frictional engagement takes place around a fixed annular wall in a circumferential path, an even drag is provided that is relatively insensitive to the position of the elevator cup along the innerbody.

The inner wall 44 of cam sleeve 30 is provided with a relaxation zone 80 so that the tab 76 has an opportunity to recall its original shape, so that the tab 76 will maintain a consistent frictional braking effect over time. In the absence of such relaxation zone 80, the tab 76 can become ineffective over time as cold flow of the tab material causes the tab 76 to deform and lose its ability to frictionally press against the cam sleeve 30. The relaxation zone 80 is located so that the tab 76 seats in the relaxation zone 80 when the elevator cup 100 of dispenser 20 is retracted and/or when fully extended. Since the consumer will typically retract the cosmetic pomade after using the dispenser 20, and since the dispenser 20 is only in actual use a small percentage of the time, this provides sufficient time for the tab 76 to relax and obtain its original molded shape. In order to increase the likelihood that the consumer will fully retract elevator cup 100, the preferred embodiment of dispenser 20 is a single turn dispenser where the consumer user can retract the elevator cup by one 360 degree turn of cylindrical portion 68.

Figure 5:
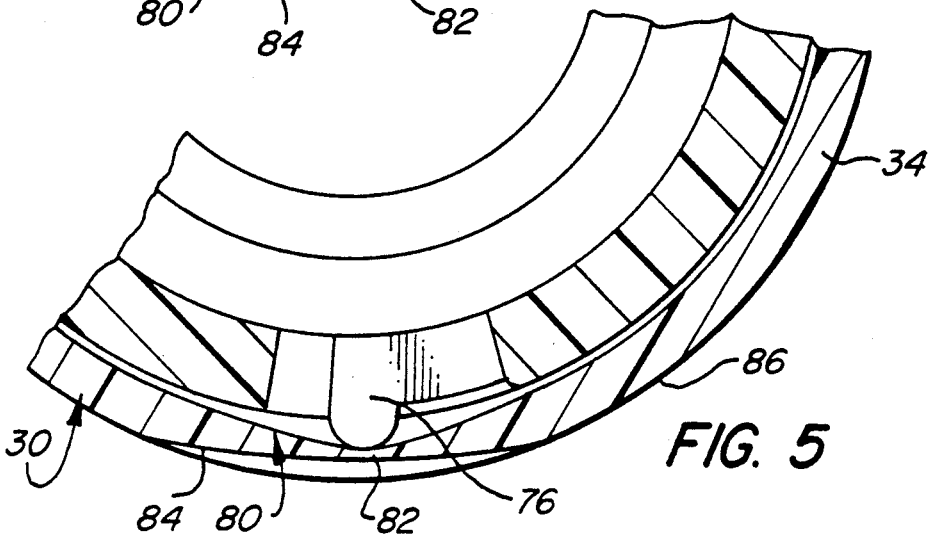
FIG. 5 is a detail cross-sectional view of FIG. 3 showing a tab and cam sleeve base wall showing the wall after deflection of the relaxation zone which comprises a deformation section in the base wall.

The relaxation zone 80 may take several embodiments. One preferred embodiment comprises a deformable section 82 of the base inner wall 44 which is made of a polymeric material. As shown in FIG. 5, the deformable section 82 yields when a tab 76 is pressed against the deformable section 82, and thereby provides tab 76 with an opportunity to regain its original shape. Such a deformable section 82 may be provided by manufacturing the base 34 of the cam sleeve 30 with flat areas 84 on the outer wall 86 of the base 34, so that the wall thickness of the base 34 is reduced to weaken the wall of base 34 only in the deformable sections. This renders the inner wall 44 deformable in accordance with the invention.

Preferably there are two such deformable sections 82 located 180 degrees apart. This permits the dispenser 20 to be assembled without insuring that a section 82 is aligned with the tab 76 on the innerbody. Instead, one of the sections 82 will automatically orient with the tab 76 when the components are assembled together to serve as the relaxation zone 80. By providing two deformable sections 82 with flat areas 84 on the outer wall 86, the inner wall 44 remains circular so that a consistent swivel drag torque is provided on the deformable section 82 that is not acting as the relaxation zone 80 for tab 76. In other words, the consumer will not notice any hesitations or variations in swivel torque when using the dispenser 20. Moreover, the integrity of the cam sleeve 30 is not compromised because the deformation sections 82 are only a small portion of the total circumference of the base 34.

Figure 4:
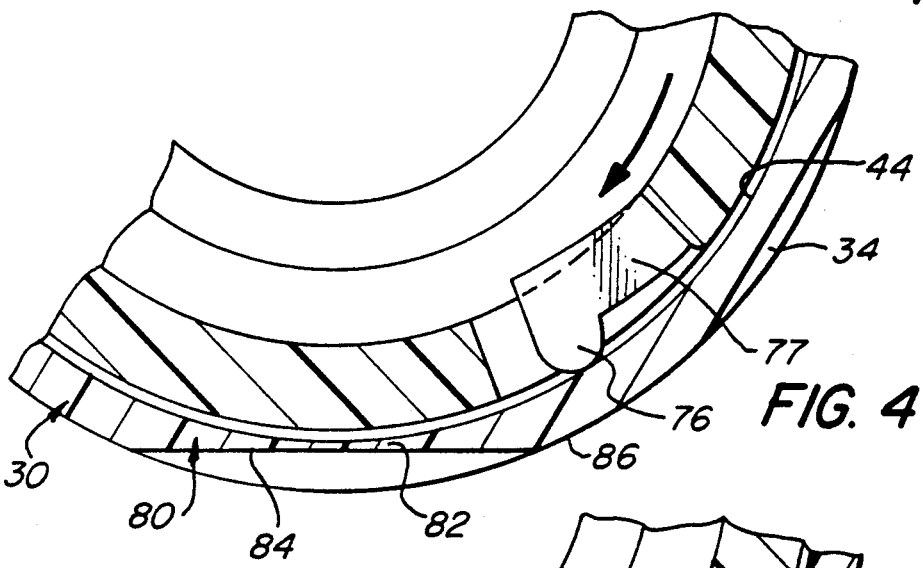
FIG. 4 is a detail cross-sectional view of FIG. 3 showing a tab frictionally bearing against a cam sleeve base wall.

As can be seen in FIGS. 4 and 5, the tab 76 will seat in and cause deformation of deformation section 82 of just the amount necessary to permit relaxation of tab 76 such that tab 76 can regain its original molded shape. It is a characteristic of molded plastics that they will seek to recover their original molded shape when relieved of forces that cause deformation of the plastic. The present invention thus permits the tab 76 to recall its original shape and characteristics.

The relaxation zone 80 is positioned on the cam sleeve 30 so that the tab 76 will seat in the relaxation zone 80 when the elevator cup 100 is fully retracted as well as when it is fully extended. The desired positioning of the components is achieved in the retracted position by placing the tab 76 directly beneath a longitudinal track 60 or 62 on the innerbody 50, and locating the deformable sections 82 on the inner 5 wall 44 in alignment with the points of intersection in the assembled dispenser of the helical tracks 40 and 42 with the lower ends of the longitudinal tracks 60 and 62. The desired positioning of the components in the extended position is also achieved by locating the intersection of the upper ends of the helical tracks 40 and 42, and the upper ends of the lateral track segments 64 and 66, in alignment with the deformable sections 82. This orientation is desirable because often a dispenser is delivered from a dispenser manufacturer to a cosmetic company with the elevator cup 100 in the extended position, as this may be required by the cosmetic company for filling the dispenser with a lipstick pomade. Since the dispenser 20 may be held in inventory prior to filling and sale in the extended position for indefinite periods, it is desirable that the relaxation effect be incorporated into the dispenser for when the elevator cup 100 is in the extended position. As prior discussed, the loaded dispenser 20 will normally be retracted after use by the consumer and the relaxation effect is therefore incorporated in the retracted position as well.

Figure 7:
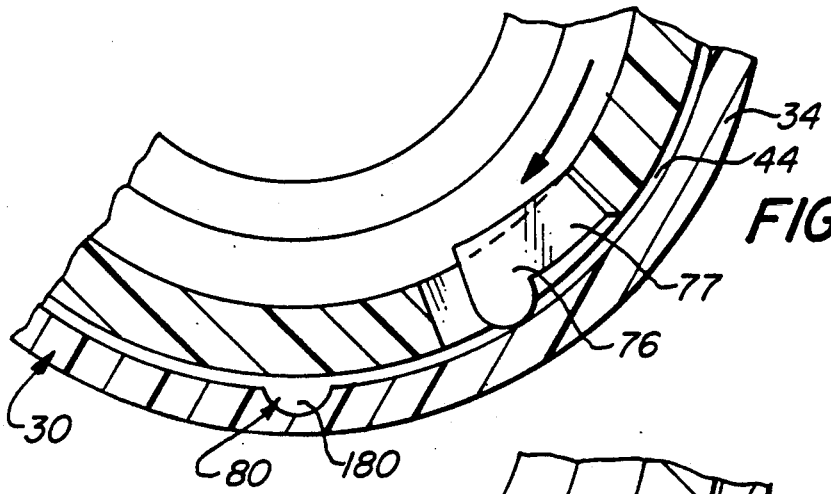
FIG. 7 is a detail cross-sectional view of an alternate embodiment of a dispenser in accordance with the invention showing a flex tab frictionally bearing against a cam sleeve base wall.
Figure 8:
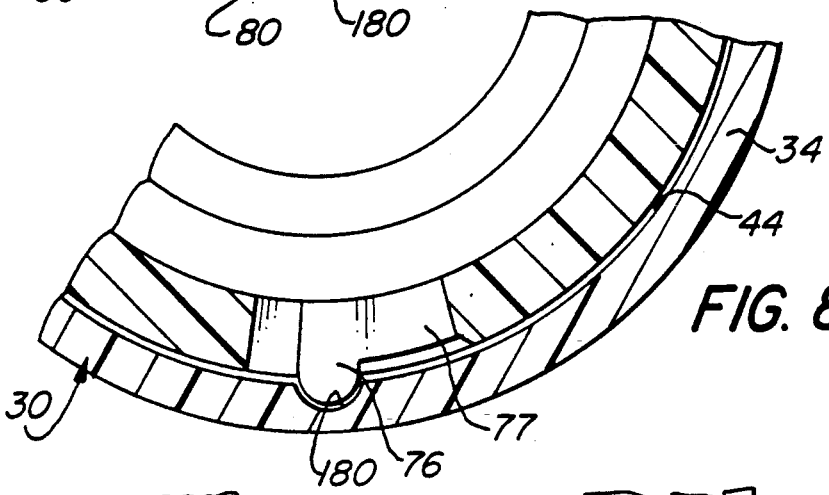
FIG. 8 is a detail cross-sectional view of the embodiment of FIG. 7 showing a tab and cam sleeve base wall showing the tab seated in a relaxation notch.

Another embodiment of the relaxation zone 80 may comprise a relaxation notch 180 in the inner wall 44 of the cam sleeve 30, as shown in FIGS. 7 and 8, although this is a less desirable embodiment because it is necessary to align cam sleeve 30 and innerbody 50 when they are assembled together in order that the tab 76 will seat in notch 180 when the dispenser is retracted or extended. It is not desirable to use two such notches 180 because, unlike the deformable sections 82 of the preferred embodiment, the notches 180 will provide an undesirable looseness and click upon rotation of the dispenser 20.

Figure 10:
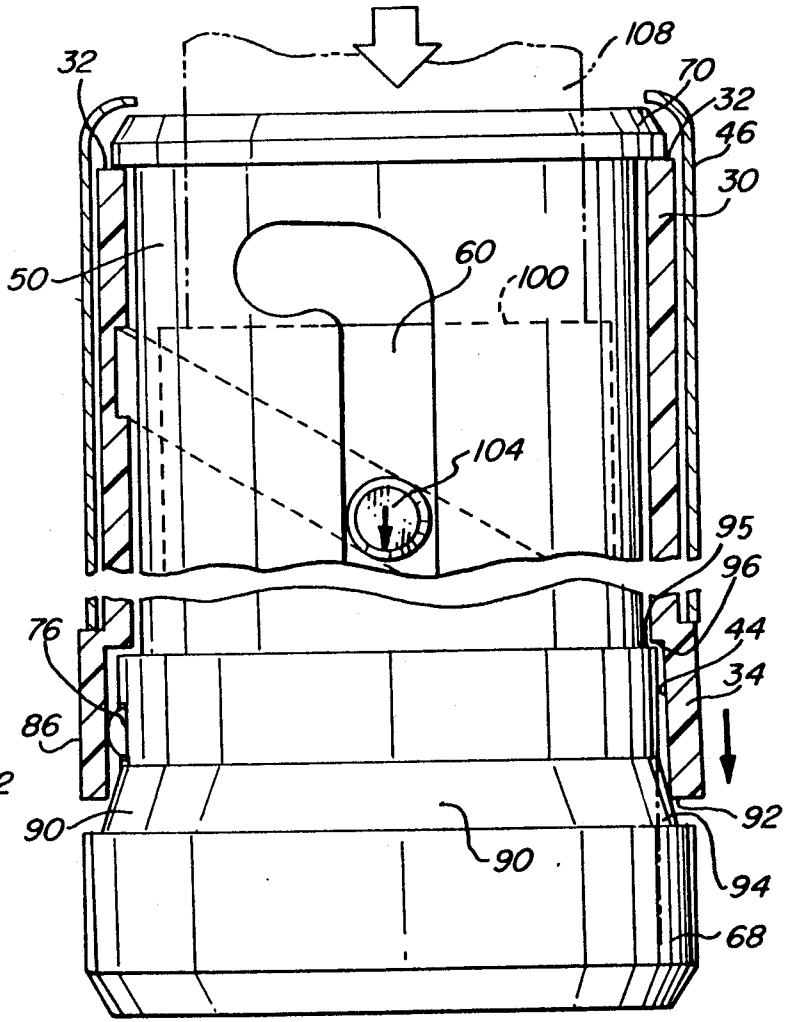
FIG. 10 is the view of FIG. 9 showing a locking effect when force is applied to the elevator cup.
Figure 9:
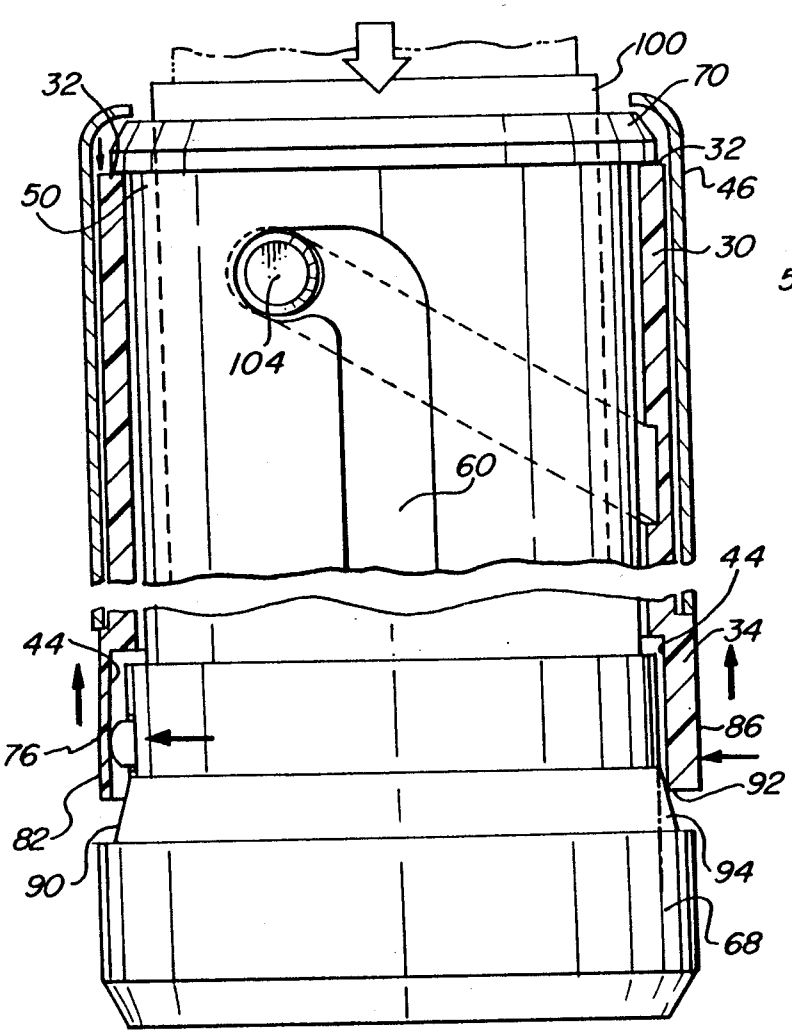
FIG. 9 is a cross-section elevation view of a bevelled shoulder of an innerbody engaging a cam sleeve in an embodiment of the invention.

The present invention provides enhanced swivel drag and eliminates undesirable pomade back-off during use of the dispenser 20 by providing a bevelled shoulder 90 at the lower end of innerbody 50 that engages the lower edge 92 of cam sleeve 30 as shown in FIGS. 9 and 10.

Referring to FIG. 9, the tab 76 provides an outwardly directed force on one side of the inner wall 44 of cam sleeve 30. This force pulls the cam sleeve 30 towards the side of innerbody 50 containing tab 76. This lateral force is translated, due to the angle of bevelled shoulder 90, into upward motion and force as lower edge 92 rides up shoulder 90. Consequently, the upper edge 32 of cam sleeve 30 is pressed against the retaining lip 70 of innerbody 50. This provides a substantial increase in swivel drag to impart the desired luxurious feel to dispenser 20. This enhanced swivel drag also helps to reduce pomade back-off by resisting relative rotation of the cam sleeve 30 and innerbody 50. Increased drag will also occur due to friction between bevelled shoulder 90 and lower edge 92. An additional benefit is that any unattractive gap that might exist between the retaining lip 70 and the upper edge 32 of the cam sleeve 30 is eliminated.

In addition, the bevelled shoulder 90 will engage lower edge 92 and act as a positive frictional lock when force is applied to pomade 108, as follows. Force, such as the pressure of a consumer's lips, is applied to pomade 108, and will be transferred to lugs 104 of elevator cup 100. Lugs 104, being seated in helical tracks 40 and 42, transfer the downward force to the cam sleeve 30. Cam sleeve 30 is thereby moved downwardly slightly until lower edge 92 is jammed against and engages shoulder 90, effectively preventing rotation of cam sleeve 30 relative to innerbody 50 when the innerbody knob 68 is held stationary.

Angle 94 of bevelled shoulder 92 is preferably in the range of about 6–20 degrees, and most preferably is 10 degrees. It has been found that the 10 degree angle provides the optimum frictional drag effect as well as an optimum locking effect.

A stop shoulder 95 is provided on innerbody 50 to receive a stop wall 96 of cam sleeve 30. Stop shoulder 95 and stop wall 96 are located to prevent an overextension of cam sleeve 30 on bevelled shoulder 90 which might cause splitting of the lower base 34 of cam sleeve 30.

Figure 11:
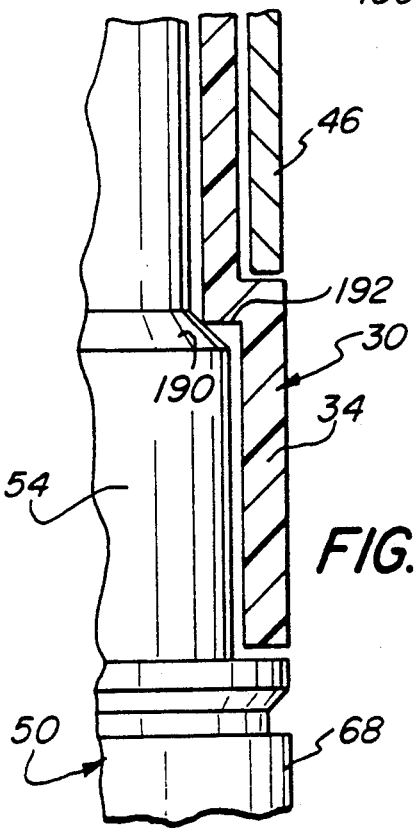
FIG. 11 is a detail cross-sectional elevation view of a lower edge of an inner wall of the cam sleeve abutting a shoulder of the innerbody in another embodiment of a dispenser in accordance with the invention.
Figure 12:
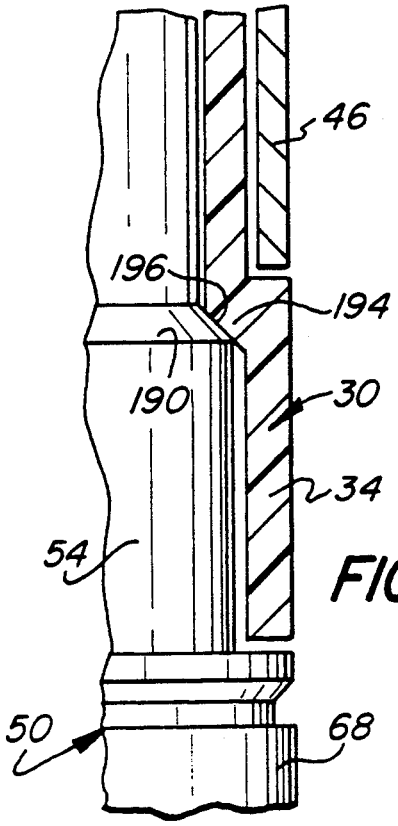
FIG. 12 is a detail cross-sectional elevation view of a lower edge of an inner wall of the cam sleeve abutting a shoulder of the innerbody in another embodiment of a dispenser in accordance with the invention.

An alternative embodiment for minimizing undesirable pomade back-off during use of the dispenser 20 is shown in FIGS. 11 and 12, wherein an interference fit is provided between a bevelled shoulder 190 on innerbody 50 and a joining wall of cam sleeve 30. Bevelled shoulder 190 is located at a higher location within cam sleeve 30 than the shoulder 90 shown in FIGS. 9 and 10. In FIG. 11, the cam sleeve joining wall 192 is a step or edged wall where an upper portion of the cam sleeve 30 joins the base wall 44. In FIG. 12, the cam sleeve joining wall 194 is bevelled to provide a mating surface 196 to fit against the bevelled shoulder 190 of innerbody 50. The joining walls 192 or 194 will press against shoulder 190 when a downward force is applied to the cam sleeve 30 and/or metal shell 46 via the pomade as described above. When the joining walls 192 or 194 are pressed against should 190, the relative rotation of the cam sleeve 30 and innerbody 50 are restricted. This embodiment thus also reduces the ability of the elevator cup 100 to retract and consequently alleviates pomade back-off.

The innerbody 50 and the cam sleeve 30 are preferably formed by molding from a thermoplastic such as styrene. The flex tab 76 is molded as part of the innerbody 50.

If desired, ornamental coverings and caps may be provided as are known in the art.

The present invention therefore provides a new and useful cosmetic dispenser with a substantially longer lasting frictional swivel drag effect than has been known in prior art dispensers, which is obtained without creating undesirable side effects.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. A cosmetic dispenser, comprising:

a tubular cam sleeve having upper and lower ends and inner and outer walls and having an internal first track extending along a substantial length of the inner wall of said cam sleeve, said cam sleeve having a tubular cam sleeve base at its lower end, said cam sleeve base having a base wall with a relaxation zone therein, said relaxation zone comprising a limited segment of said base wall and having a thinner wall than the adjoining base wall;

a tubular innerbody having upper and lower ends, said innerbody being fitted into said tubular cam sleeve and being provided with a second track extending through the wall of said innerbody along a substantial length of said innerbody;

a resilient tab formed with and attached to said lower end of said innerbody and being at least partially cut away from said innerbody, said tab frictionally engaging and bearing against said base wall of said cam sleeve such that said tab is flexed radially inwardly from a tab root joining the tab to the innerbody, said tab being released from radially inward flexing when said tab is seated in said relaxation zone in said base wall; and a generally cylindrical elevator cup for containing a cosmetic preparation, fitted into said innerbody and having a cam follower lug extending through said second track to engage said first track, said elevator cup being movable in an axial path by relative rotation of said innerbody and cam sleeve.

2. A cosmetic dispenser in accordance with claim 1, wherein said relaxation zone is located such that said tab is seated in said relaxation zone when said dispenser is in a retracted position.

3. A cosmetic dispenser in accordance with claim 1, wherein said relaxation zone is located such that said tab is seated in said relaxation zone when said dispenser is in an extended position.

4. A cosmetic dispenser in accordance with claim 1, wherein said cam sleeve base is formed of a polymeric material and said relaxation zone in said base wall has a thinner wall thickness than remaining portions of said base wall, whereby said relaxation zone is deformable by application of pressure thereto by said tab.

5. A cosmetic dispenser in accordance with claim 4, wherein said thinner wall thickness of said relaxation zone is provided by providing a flat area on an outer wall of said base wall.

6. A cosmetic dispenser in accordance with claim 1, wherein said relaxation zone in said base wall comprises a relaxation notch in an inner wall of said base wall.

7. A cosmetic dispenser in accordance with claim 4, wherein there is a single resilient tab and two of said relaxation zones.

8. A cosmetic dispenser in accordance with claim 7, wherein said relaxation zones are located 180 degrees apart on said base wall.

9. A cosmetic dispenser in accordance with claim 1, wherein said innerbody is provided with a bevelled shoulder around a lower outer wall thereof, and wherein said cam sleeve base wall has a lower edge, said lower edge being located against said shoulder, wherein there are not more than one of said flex tabs, and said one flex tab when it is not located in a said relaxation zone presses radially outwardly against said cam sleeve base wall and causes said cam sleeve to lift upwardly on said bevelled shoulder to provide a frictional engagement between a retaining lip of said innerbody and an upper edge of said cam sleeve.

10. A cosmetic dispenser in accordance with claim 9, wherein said bevelled shoulder has an angle of between about 6 to about 20 degrees from an axis of said innerbody.

11. A cosmetic dispenser in accordance with claim 10, wherein said angle of said bevelled shoulder is about 10 degrees.

12. A cosmetic dispenser, comprising:

a tubular cam sleeve having upper and lower ends and inner and outer walls and having two internal helical tracks located 180 degrees apart and extending along a substantial length of the inner wall of said cam sleeve, and having an unthreaded tubular cam sleeve base at its lower end, said cam sleeve base having a base wall having relaxation zones about 180 degrees apart in an inner wall thereof, said cam sleeve base being formed of a deformable material, said relaxation zones having a thinner wall thickness than remaining portions of said base wall, whereby said relaxation zones are deformable by application of pressure thereto;

a tubular innerbody having upper and lower ends, said innerbody being fitted into said tubular cam sleeve and being provided with two longitudinal tracks extending through the wall of said innerbody along a substantial length of said innerbody;

a single resilient flex tab formed with and attached to said lower end of said innerbody, said tab being at least partially cut away from said innerbody to enhance resilience of said tab, and being provided with a radially outwardly extending member to provide a frictional engagement with said cam sleeve base, said tab being released from bearing against said base wall when said tab is seated in a relaxation zone in said base wall;

a generally cylindrical elevator cup for containing a cosmetic preparation, fitted into said innerbody and having two cam follower lugs located 180 degrees apart and having a sufficient length to extend through said longitudinal track to engage said helical tracks, said elevator cup being movable in an axial path by relative rotation of said innerbody and cam sleeve to extend and retract said cup.

13. A cosmetic dispenser in accordance with claim 12, said relaxation zones being located in said base wall and said longitudinal tracks and helical tracks being sized such that said tab is seated in a relaxation zone when said cup is in a position selected from the group consisting of a retracted position and an extended position.

14. A cosmetic dispenser in accordance with claim 13, wherein flat areas are provided on an outer wall of said cam sleeve base wall to obtain said thinner wall thickness of said relaxation zones.

15. A cosmetic dispenser in accordance with claim 14, wherein said innerbody is provided with a bevelled shoulder around a lower outer wall thereof, and wherein said cam sleeve base wall has a lower edge located against said shoulder, wherein said flex tab causes said cam sleeve to rise on said bevelled shoulder to provide a frictional engagement between a retaining lip of said innerbody and an upper edge of said cam sleeve.

16. A cosmetic dispenser in accordance with claim 15, wherein said bevelled shoulder has an angle of between about 6 to about 20 degrees from an axis of said innerbody.

17. A cosmetic dispenser in accordance with claim 16, wherein said angle of said bevelled shoulder is about 10 degrees.

18. In a cosmetic dispenser, comprising: a tubular cam sleeve having upper and lower ends and inner and outer walls and having an internal first track extending along a substantial length of the inner wall of said cam sleeve; a tubular innerbody having upper and lower ends, said innerbody being fitted into said tubular cam sleeve and being provided with a second track extending through the wall of said innerbody along a substantial length of said innerbody; and a generally cylindrical elevator cup for containing a cosmetic preparation fitted into said innerbody and having a cam follower lug extending through said second track to engage said first track whereby said elevator cup is movable in an axial path by relative rotation of said innerbody and cam sleeve; the improvement comprising:

a resilient tab molded of a polymeric material with and attached to said lower end of said innerbody, said tab having an end for frictionally engaging a smooth relatively stiff inner tubular base wall of said lower end of said cam sleeve, such that said tab is flexed radially inwardly from a tab root joining the tab to the innerbody, said tab being released from radially inward flexing when said tab is seated in a relaxation zone in said base wall; and said relaxation zone comprising a deformable section of said relatively stiff base wall that yields when said tab is pressed against said relaxation zone to thereby permit said tab to recall its original molded shape.

19. A cosmetic dispenser in accordance with claim 18, wherein said cam sleeve base wall is formed of a polymeric material, and said relaxation zone in said base wall has a thinner wall thickness than remaining portions of said base wall, whereby said relaxation zone is deformable by application of pressure thereto by said tab.

20. A cosmetic dispenser in accordance with claim 19, wherein said thinner wall thickness of said relaxation zone is provided by forming said base wall with a flat area on an outer wall of said base wall.

21. A cosmetic dispenser in accordance with claim 20 wherein said relaxation zone is located such that said tab is seated in said relaxation zone when said dispenser is in a position selected from the group consisting of a retracted position and a fully extended position.

22. A cosmetic dispenser in accordance with claim 21, wherein there are two said relaxation zones located 180 degrees apart on opposite sides of said innerbody and said base wall.

23. A cosmetic dispenser, comprising:

a tubular cam sleeve;

a tubular innerbody, said innerbody being fitted into said tubular cam sleeve;

a resilient tab element formed with and extending radially from one of said innerbody or cam sleeve, said tab having an end for frictionally engaging an opposing surface provided on the other of said innerbody or cam sleeve to provide a frictional braking effect therebetween upon the relative rotation of said innerbody and cam sleeve, said tab being flexed by said frictional engaging and said tab being released from flexing when said tab is seated in a relaxation zone in said opposing surface, said relaxation zone comprising a deformable section of said opposing surface made of a polymeric material which yields when said tab is pressed against said relaxation zone.

24. A cosmetic dispenser in accordance with claim 23 wherein said relaxation zone is located such that said tab is seated in said relaxation zone when said dispenser is in a retracted position and in a fully extended position.

25. A cosmetic dispenser in accordance with claim 24, wherein said relaxation zone has a thinner wall thickness than remaining portions of said opposing surface, whereby said relaxation zone is less rigid than said remaining portions and is deformable by application of pressure thereto by said tab.

26. A cosmetic dispenser in accordance with claim 25, wherein said thinner wall thickness of said relaxation zone is provided by forming a flat area on a wall of said opposing surface.

27. A cosmetic dispenser, comprising:

a cam sleeve having upper and lower ends and inner and outer walls and having an internal helical track extending along a substantial length of the inner wall of said cam sleeve, said cam sleeve having a tubular cam sleeve base having a lower edge at its lower end;

an innerbody having upper and lower ends, said innerbody being fitted into said tubular cam sleeve and being provided with a longitudinal track extending through the wall of said innerbody along a substantial length of said innerbody, said innerbody having a retaining lip at its upper end to retain said cam sleeve thereto, and having a bevelled shoulder around a lower outer wall thereof, said cam sleeve base lower edge being located against said shoulder;

means for pressing radially outwardly against one side of said cam sleeve base whereby said cam sleeve is upwardly lifted by the translation of outward pressing forces applied by said means for pressing radially outwardly into lifting forces along said shoulder to cause a frictional engagement between said upper end of said cam sleeve and said retaining lip of said innerbody;

a generally cylindrical elevator cup for containing a cosmetic preparation, fitted into said innerbody and having a cam follower lug extending through said longitudinal track to engage said helical track, said elevator cup being movable in an axial path by relative rotation of said innerbody and cam sleeve.

28. A cosmetic dispenser in accordance with claim 27, wherein said bevelled shoulder has an angle of between about 6 to about 20 degrees from an axis of said innerbody.

29. A cosmetic dispenser in accordance with claim 28, wherein said angle of said bevelled shoulder is about 10 degrees.

30. A cosmetic dispenser in accordance with claim 27, further comprising a relaxation zone in an inner surface of a base wall of said cam sleeve base, and wherein said means for pressing radially outwardly comprises a single resilient tab formed with and attached to said lower end of said innerbody, said tab frictionally engaging and bearing against said base wall of said cam sleeve to lift said cam sleeve and whereby said tab is flexed radially inwardly from a tab root joining the tab to the innerbody, said tab being released from said inward flexing when said tab is seated in said relaxation zone in said base wall, said relaxation zone being located such that said tab is seated in said relaxation zone when said dispenser is in a selected position.

* * * * *